US007451788B2

(12) United States Patent
Griffith

(10) Patent No.: US 7,451,788 B2
(45) Date of Patent: Nov. 18, 2008

(54) APPARATUS AND METHOD FOR WEAVING LENO FABRIC

(75) Inventor: John Dalton Griffith, Sunderland (GB)

(73) Assignee: Griffith Textile Machines Limited (GB)

( * ) Notice: Subject to any disclaimer, the term of this patent is extended or adjusted under 35 U.S.C. 154(b) by 243 days.

(21) Appl. No.: 11/437,500

(22) Filed: May 19, 2006

(65) Prior Publication Data

US 2006/0272729 A1 Dec. 7, 2006

(30) Foreign Application Priority Data

May 20, 2005 (GB) ..... 0510269.4

(51) Int. Cl.

| | |
|---|---|
| ***D03C 7/00*** | (2006.01) |
| ***D03C 7/04*** | (2006.01) |
| ***D03C 7/08*** | (2006.01) |
| *D03C 11/00* | (2006.01) |

(52) U.S. Cl. ..... 139/53; 139/1 E; 139/50; 139/52

(58) Field of Classification Search ..... None
See application file for complete search history.

(56) References Cited

U.S. PATENT DOCUMENTS

| | | | | |
|---|---|---|---|---|
| 1,435,615 | A * | 11/1922 | Moreau | 139/53 |
| 1,470,862 | A * | 10/1923 | Minville | 139/53 |
| 3,131,728 | A * | 5/1964 | Yves | 139/54 |
| 3,952,778 | A * | 4/1976 | Volpe | 139/54 |
| 4,580,605 | A | 4/1986 | Gosciniak et al. | |
| 4,589,450 | A | 5/1986 | Eisenlohr | |

(Continued)

FOREIGN PATENT DOCUMENTS

EP 534629 A1 * 3/1993

(Continued)

OTHER PUBLICATIONS

Search Report dated Aug. 16, 2005.

*Primary Examiner*—Bobby H Muromoto, Jr.
(74) *Attorney, Agent, or Firm*—Nikolai & Mersereau, P.A.; C. G. Mersereau

(57) ABSTRACT

An apparatus for weaving leno fabric on a loom including a support pivotally mounted on a loom, and carrying a plurality of ground thread blades arranged side by side in a row and spaced apart to define guide spaces therebetween for ground threads. A leno guide blade divides each guide space into first and second guide slots, each leno guide blade having a leno guide eye through which a leno thread is guided, adjacent ground thread blades projecting beyond the terminal end of the leno guide blade located therebetween to define a ground thread cross-over space. The ground thread blades and leno guide blades are arranged such that pivotal movement of the support in a first rotary direction causes the ground threads to move relatively along one of the first or second guide slots towards and into the crossover spaces such that lateral movement of the ground threads relative to respective leno guide blades, from one side to the other thereof, causes closing of one guide slot and opening of the other, whereby pivotal movement of the support in a rotary direction opposite the first rotary direction causes movement of the ground threads relative to the ground thread blades out of the crossover spaces and relatively along the other of the first or second guide slots away from the crossover spaces.

20 Claims, 6 Drawing Sheets

U.S. PATENT DOCUMENTS

| | | | | |
|---|---|---|---|---|
| 4,721,135 | A * | 1/1988 | Tsubata et al. | 139/46 |
| 5,085,253 | A * | 2/1992 | Motta | 139/50 |
| 5,394,905 | A * | 3/1995 | Griffith | 139/50 |
| 5,419,375 | A * | 5/1995 | Corain et al. | 139/54 |
| 6,386,241 | B1 * | 5/2002 | Griffith | 139/192 |
| 7,073,537 | B2 * | 7/2006 | Wahhoud et al. | 139/50 |
| 2002/0121311 | A1 | 9/2002 | Baumann et al. | |

FOREIGN PATENT DOCUMENTS

| | | |
|---|---|---|
| EP | 1 277 862 | 1/2003 |
| EP | 1 348 786 | 2/2003 |
| GB | 1013176 | 8/1964 |
| GB | 1341281 | 5/1971 |
| WO | WO 98/07913 | 2/1998 |

* cited by examiner

APPARATUS AND METHOD FOR WEAVING LENO FABRIC

This invention relates to a method and an apparatus for weaving leno fabric on a loom and also a leno mechanism for incorporation into a heald frame loom to enable the loom to weave leno fabric.

A woven leno fabric is a well known type of open weave having the construction shown in FIG. 1.

A general aim of the invention is to allow the production of a leno fabric using a minimum number of moving parts and a minimum number of wear surfaces so that such a fabric can be woven reliably at high speed.

According to a first aspect of the invention there is provided an apparatus, for weaving leno fabric on a loom, including:

a support having pivot means which enable the support to be pivotally mounted on the loom for reciprocal pivotal rotation about a pivot axis, the support carrying a plurality of ground thread blades arranged side by side in a row and spaced apart along the row to define inbetween neighbouring ground thread blades a guide space for a ground thread running along a predetermined pathway, a leno guide blade being located in each guide space to divide the guide space into first and second guide slots, each leno guide blade having at its terminal end a leno guide eye through which a leno thread is to be guided, adjacent ground thread blades projecting beyond the terminal end of the leno guide blade located therebetween to define a ground thread cross-over space, the ground thread and leno guide blades being arranged to extend from said pivotal axis as defined by the pivot means such that pivotal movement of the support in a first rotary direction causes the ground threads to move relatively along one of the first or second guide slots towards and into the cross-over spaces and thereby permit the ground threads to be moved laterally relative to the leno guide blades from one side to the other thereof; and such that pivotal movement of the support in a second rotary direction opposite to the said first rotary direction causes the ground threads to move relative to the ground thread blades out of the cross-over spaces and relatively along the other of the first or second guide slots away from the cross-over spaces.

The foregoing arrangement allows for the relative movement of the ground threads to come about by pivotal movement, thereby utlising a minimum number of moving parts and a minimum number of wear surfaces.

Preferably the apparatus further includes a ground thread deflection means operable on the ground threads for causing each ground thread to be moved laterally to one side or the other of a respective leno guide blade.

Optionally the ground thread deflection means comprises a reciprocating bar having a plurality of guide eyes for guiding respective ground threads, the reciprocating bar being movable between first and second positions so as to cause the said lateral movement of the ground threads relative to the leno guide blades.

The foregoing arrangements provide a convenient way of moving the ground threads relative to the leno guide blades such that the threads are able to cross-over one another to define a desired leno fabric construction.

In a preferred embodiment of the invention each ground thread blade is sufficiently flexible to enable a ground thread to cause it to be deflected laterally relative to a neighbouring leno guide blade. This provides for positive locating of the ground threads within respective guide spaces, thereby maintaining a desired degree of control over the said ground threads.

Preferably the neighbouring ground thread blades include a retaining means connected between the terminal ends thereof in order to prevent ground threads moving beyond the terminal ends of the ground thread blades and out of said cross-over spaces. Such an arrangement provides for further control of the ground threads.

Optionally the retaining means comprises an elongate member which extends across and is connected to the terminal ends of the row of ground thread blades. This is a convenient way of achieving the desired retention of the ground threads.

In a further preferred embodiment of the invention the terminal ends of the leno guide blades and the ground thread blades lie in different radial planes. Such an arrangement reduces the range of pivotal movement of the support required to move the ground threads relatively into and out of the cross-over spaces.

According to a second aspect of the invention there is provided a leno mechanism, for incorporation into a heald frame loom to enable the heald frame loom to weave leno fabric, including:

a support having pivot means which enable the support to be pivotally mounted on the heald frame loom for reciprocal pivotal rotation about a pivot axis, the support carrying a plurality of ground thread blades arranged side by side in a row and spaced apart along the row to define inbetween neighbouring ground thread blades a guide space for a ground thread running along a predetermined pathway, a leno guide blade being located in each guide space to divide the guide space into first and second guide slots, each leno guide blade having at its terminal end a leno guide eye through which a leno thread is to be guided, adjacent ground thread blades projecting beyond the terminal end of the leno guide blade located therebetween to define a ground thread cross-over space, the ground thread and leno guide blades being arranged to extend from said pivotal axis as defined by the pivot means such that pivotal movement of the support in a first rotary direction causes the ground threads to move relatively along one of the first or second guide slots towards and into the cross-over spaces and thereby permit the ground threads to be moved laterally relative to the leno guide blades from one side to the other thereof; and such that pivotal movement of the support in a second rotary direction opposite to the said first rotary direction causes the ground threads to move relative to the ground thread blades out of the cross-over spaces and relatively along the other of the first or second guide slots away from the cross-over spaces.

Preferably the leno mechanism further includes a ground thread deflection means operable on the ground threads for causing each ground thread to be moved laterally to one side or the other of a respective leno guide blade.

The foregoing features share the advantages of the corresponding apparatus features mentioned hereinabove.

Optionally the support is adapted to be driven by a heald frame drive.

In a further embodiment of the invention the ground thread deflection means is adapted to be driven by a rotating driveshaft of the heald frame loom.

The foregoing features allow for the convenient use of the leno mechanism with a heald frame loom following a minimum of modification thereto.

According to a third aspect of the invention there is provided a method of weaving leno fabric on a loom comprising the steps of:

(i) arranging a row of side by side ground thread blades to define a plurality of guide spaces, each guide space being for a respective ground thread running along a predetermined pathway;

(ii) arranging a respective leno guide blade within each guide space to define first and second guide slots and a cross-over space therein;

(iii) guiding each leno thread with a respective leno guide blade;

(iv) moving the ground threads relatively along one of the first or second guide slots towards and into the cross-over spaces by pivotally moving the support in a first rotary direction;

(v) moving the ground threads laterally relative to the leno guide blades from one side to the other thereof; and (vi) moving the ground threads out of the cross-over spaces and relatively along the other of the first or second guide slots away from the cross-over spaces by pivotally moving the support in a second rotary direction opposite to the said first rotary direction.

This allows for the weaving of leno fabric while utilising a minimum number of moving parts and a minimum number of wear surfaces.

Preferably step (v) includes guiding each ground thread via a ground thread deflection means.

Optionally, guiding each ground thread via a ground thread deflection means includes guiding each ground thread via a guide eye within a reciprocating bar.

The foregoing steps allow the ground threads and leno threads to cross-over one another to define a desired leno fabric construction.

In another preferred embodiment of the invention step (v) further includes deflecting each ground thread laterally relative to a respective leno guide blade so as to cause it to abut and deflect a neighbouring ground thread blade.

Conveniently the method further comprises the step of retaining each ground thread within each guide space.

The foregoing steps provide for a desired retention of the ground threads within the guide spaces.

There now follows a brief description of a preferred embodiment of the invention, by way of non-limiting example, with reference being made to the accompanying drawings in which.

Figure 1:
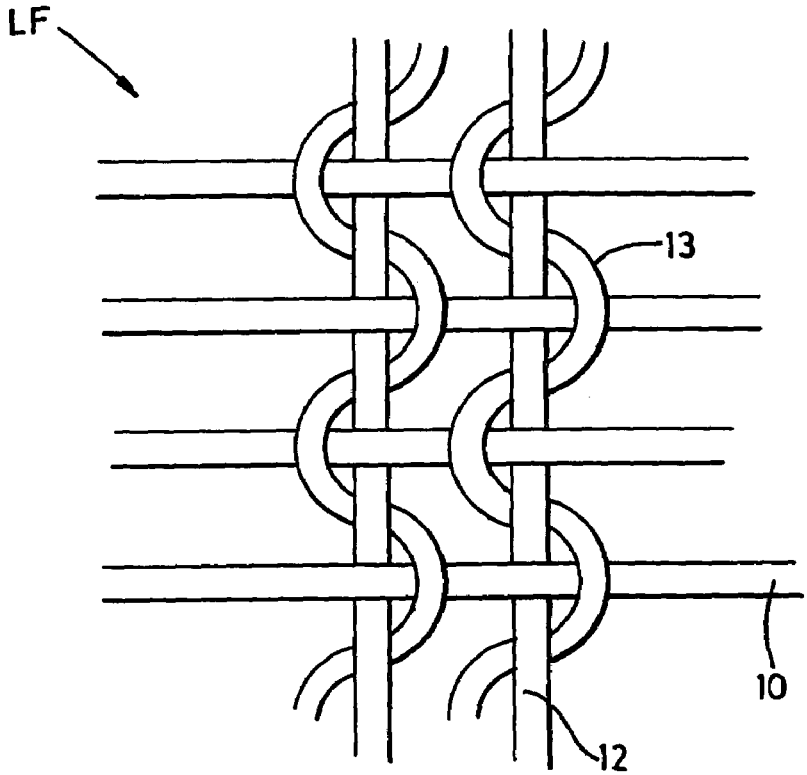
Fig. 1 (PRIOR ART)
FIG. 1 shows the leno fabric construction.
Figure 2:
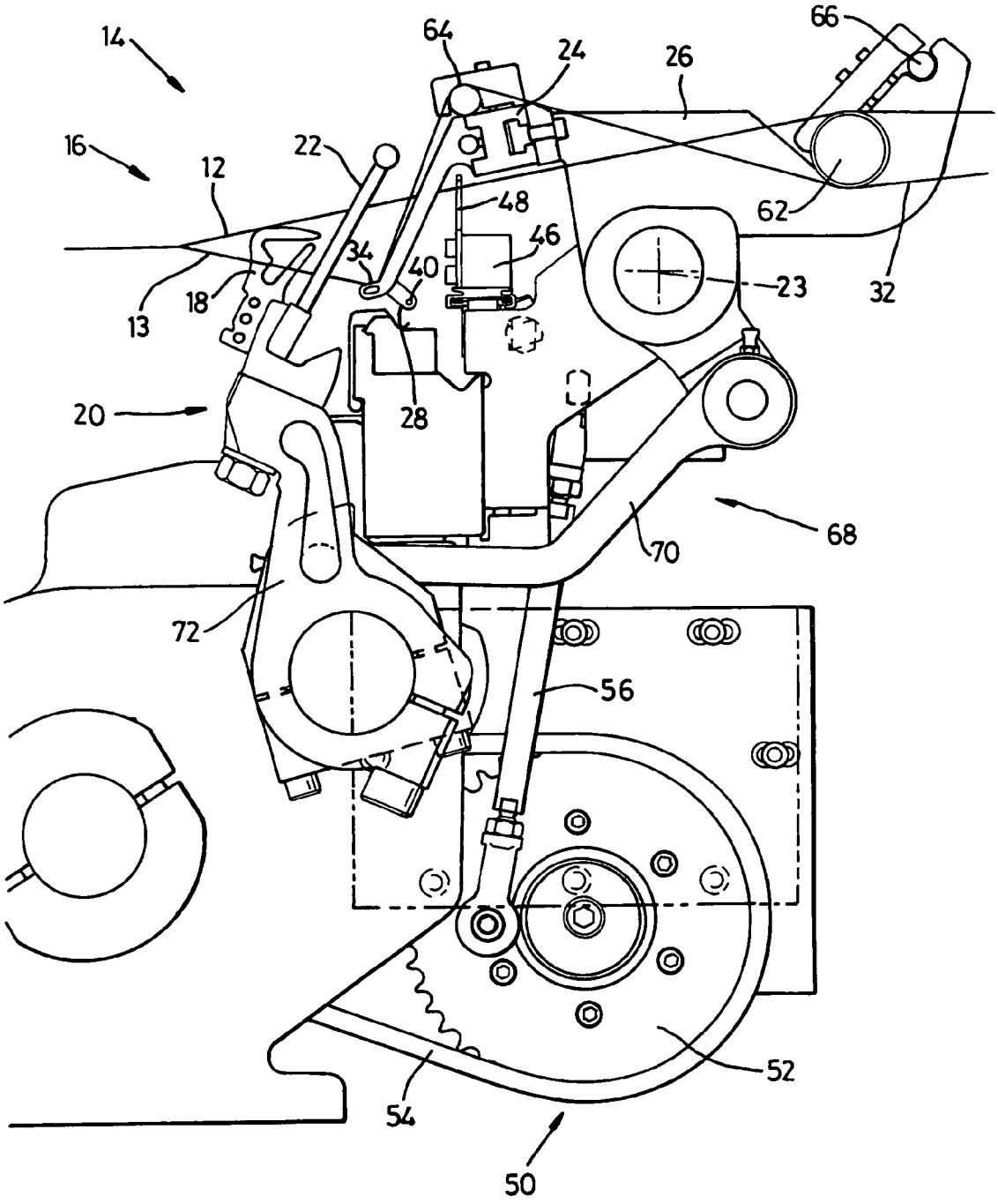
FIGS. 2 and 3 are elevational views from one end of an apparatus according to a first embodiment of the invention shown in weft insertion and beat-up positions of the loom, respectively.
Figure 6:
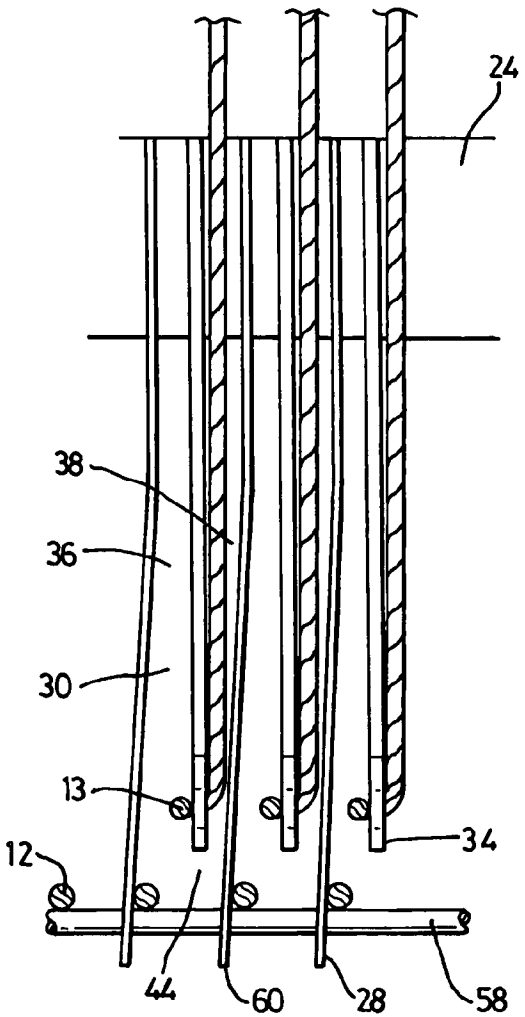
Figure 5:
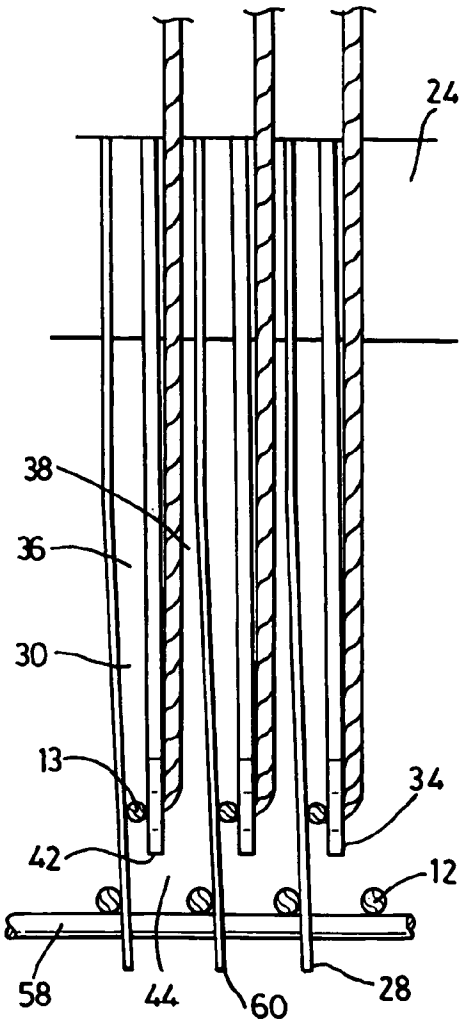
Figure 7:
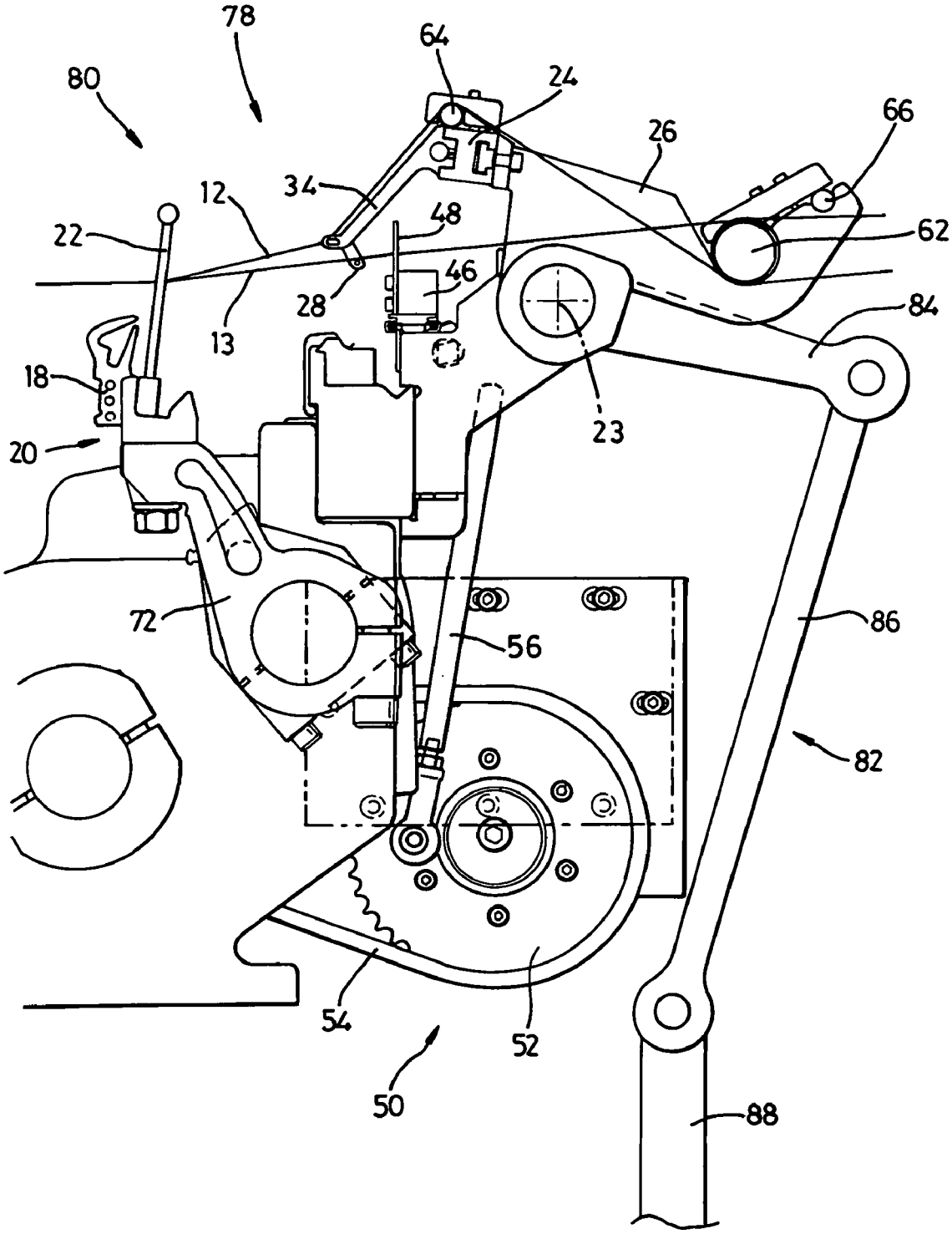

FIGS. 5 and 6 are front elevational views of ground thread blades and leno guide blades of the apparatus shown in FIG. 2; and FIG. 7 shows a leno mechanism according to a second embodiment of the invention The woven leno fabric LF comprises of weft 10, ground threads 12 and leno threads 13 locked together, as shown in FIG. 1.

An apparatus for weaving leno fabric on a loom is designated generally by the reference numeral 14. In the embodiment shown the loom is a projection loom 16 which, as is well known in the art, includes a plurality of guides 18 to guide the projectiles (not shown) which insert the weft 10. The guides 18 are mounted on a reed assembly 20 which includes a reed 22.

The weaving apparatus 14 includes a support in the form of a bar 24 which is pivotally mounted to the loom 16 via a plurality of brackets 26 spaced thereacross. The brackets 26 define a pivot axis 23 about which the bar 24 is pivotally rotatable.

Figure 4:
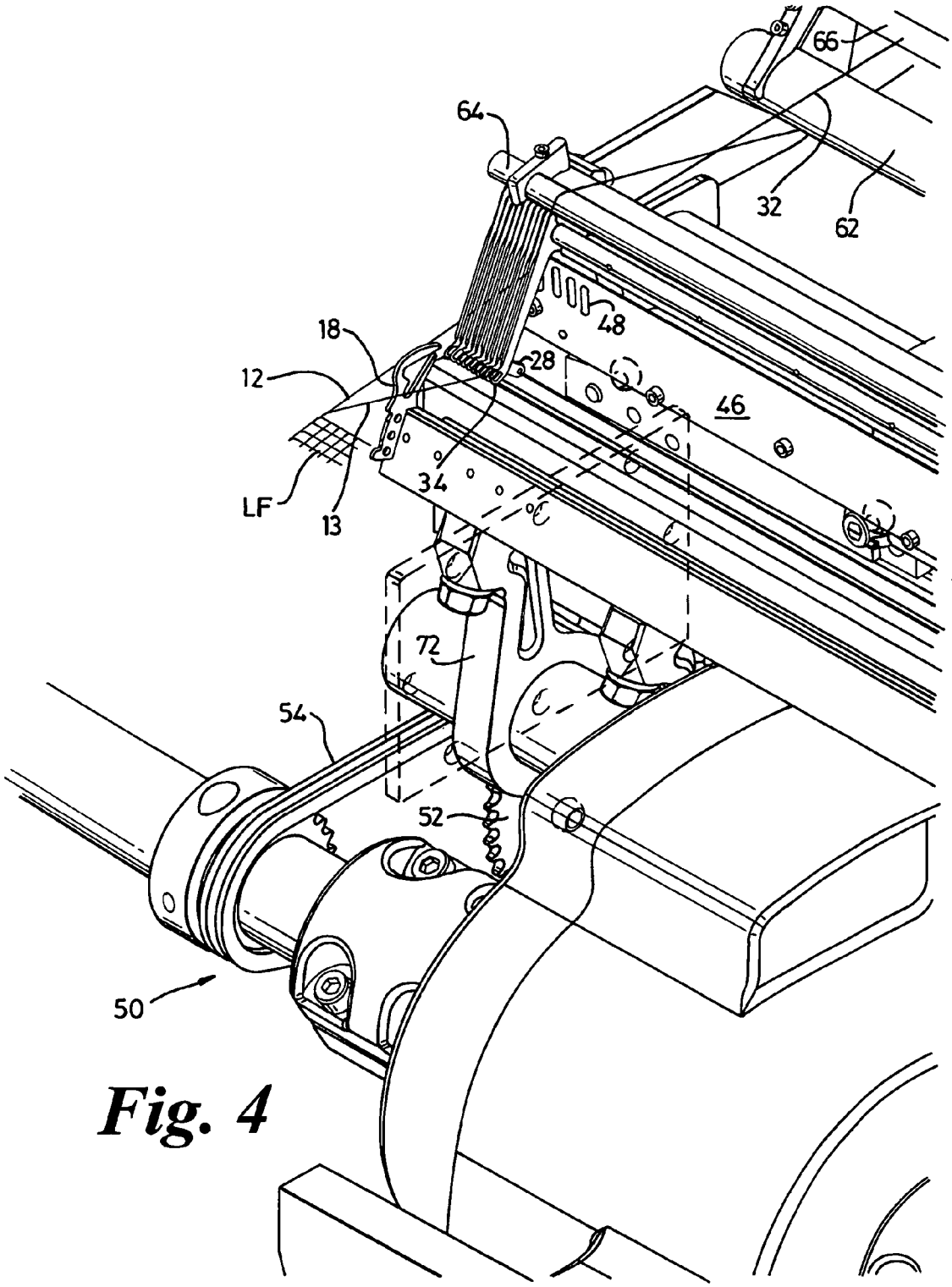
FIG. 4 is a part perspective view of the mechanism shown in FIG. 2.

The bar 24 carries a plurality of ground thread blades 28 extending therefrom and arranged side by side in a row, as shown in FIG. 4.

The ground thread blades 28 are spaced apart along the row to define inbetween neighbouring ground thread blades 28 a guide space 30 for a ground thread running along a predetermined pathway from a rear 32 of the loom 16, as shown in FIGS. 5 and 6.

A leno guide blade 34 is located in each guide space 30 to divide the guide space 30 into first and second guide slots 36, 38.

Each leno guide blade 34 includes a leno guide eye 40, at a terminal end 42 thereof, for guiding a respective leno thread 13.

Adjacent ground thread blades 28 project beyond the terminal end 42 of the leno guide blade 34 to define a ground thread cross-over space 44.

The weaving apparatus 14 also includes a ground thread deflection means in the form of a reciprocating bar 46. The reciprocating bar 46 includes a plurality of guide eyes 48 for guiding respective ground threads. Preferably the guide eyes 48 are in the form of slots. The reciprocating bar 46 is moveable between first and second positions so as to cause lateral movement of the ground threads 12 relative to the leno guide blades 34.

A chain drive assembly 50 for driving the reciprocating bar 46 includes a small sprocket wheel (not shown), a large sprocket wheel 52 connected to the small sprocket wheel via a chain 54, and a crank rod 56 connected between the large sprocket wheel 52 and the reciprocating bar 46.

In addition, in the embodiment shown neighbouring ground thread blades 28 include a retaining means in the form of a wire 58 connected between terminal ends 60 thereof. The wire 58 prevents ground threads 12 from moving beyond the terminal ends 60 of the ground thread blades 28 and out of the cross-over spaces 44.

Furthermore, the weaving apparatus 14 of the embodiment shown includes first and second guide bars 62, 64. Optionally the weaving apparatus 14 may also include a third guide bar 66.

The leno threads 13 are arranged to pass under the first guide bar 62 and then over the second guide bar 64 as they pass from a rear 32 of the loom 16 to a front thereof. Such an arrangement helps to maintain a substantially constant tension in the leno threads 13 during operation of the apparatus 14.

The ground threads 12 are arranged to pass over the first guide 10. Optionally the ground threads may also pass under the third guide 66.

The first embodiment weaving apparatus 14 also includes a first drive assembly 68 having a connecting rod 70 interconnected between the brackets 26 and a pivot arm 72 of the reed assembly 20.

Figure 3:
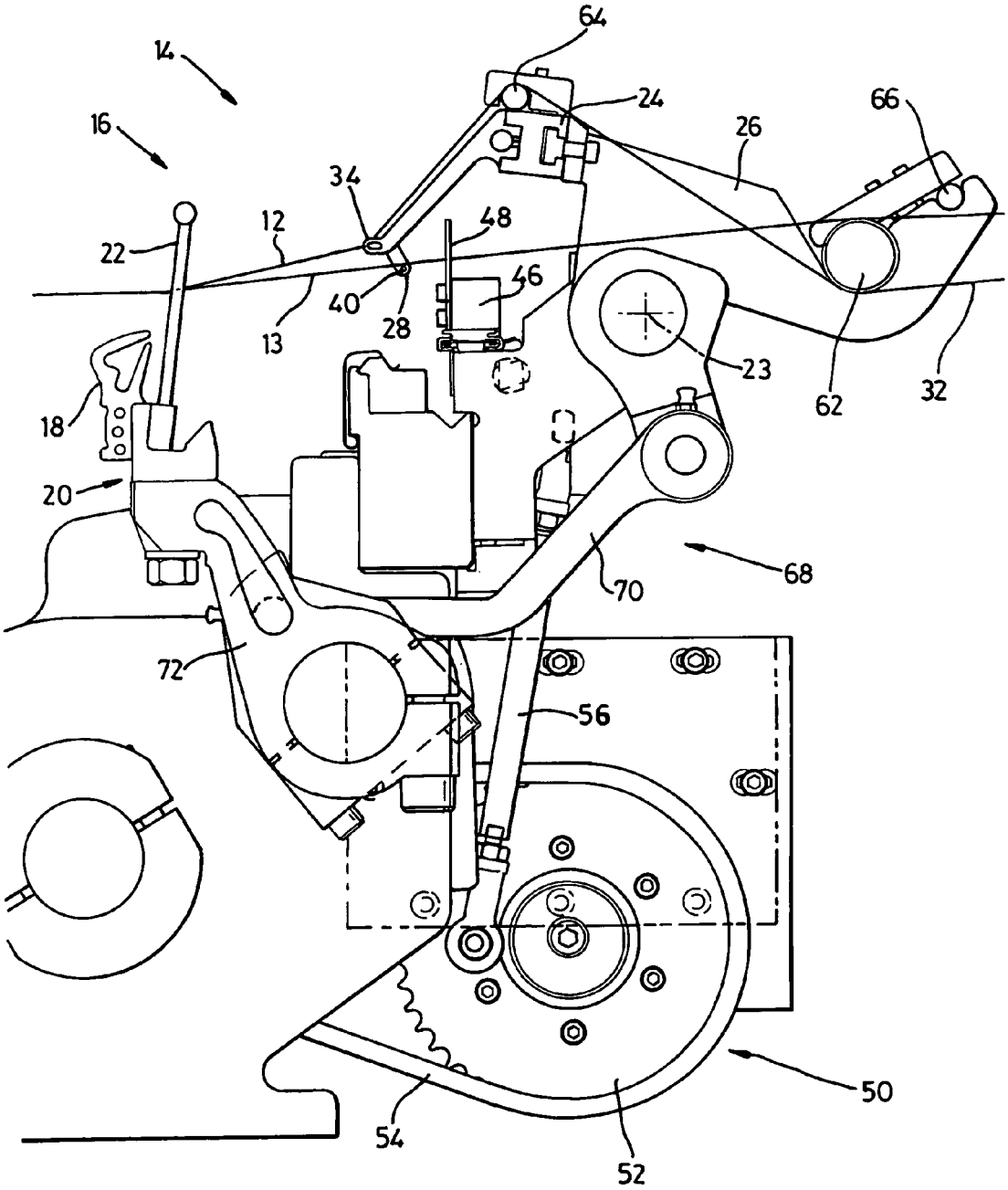

During weaving the first drive assembly 68 pivotally rotates the bar 24 about the pivot axis 23 in a first direction as well as moving the reed assembly 20 in a first direction towards a beat-up position whereat the reed 22 has pushed the weft (not shown) forward into the leno fabric LF, as shown in FIG. 3.

Pivotal movement of the bar 24 in the first, rotary direction causes the ground threads 12 to move relatively along one of the first or second guide slots 36, 38 towards and into the cross-over spaces 44.

This permits the reciprocating bar 46 to move of the ground threads 12 laterally relative to the leno guide blades 34 from a one side to the other thereof. In this way the ground threads 12 and leno threads 13 cross over one another. The ground thread blades 28 are flexible and so the ground threads 12 cause them to deflect laterally relative to a neighbouring leno guide blade 34, thereby positively retaining each ground thread 12 within a respective guide space 30.

Subsequent pivotal movement of the bar 24 in a second, rotary direction opposite the first rotary direction causes the ground threads 12 to move relative to the ground thread blades 28 out of the cross-over spaces 44 and relatively along the other of the first and second guide slots 36, 38 away from the cross-over spaces 44.

While moving the bar 24 in the second rotary direction, the first drive assembly 68 moves the reed assembly 20 towards a weft insertion position whereat the ground and leno threads 12, 13 form an open shed for weft 10 insertion, as shown in FIG. 2.

In this way the ground threads 12 and leno threads 13 are wrapped about one another inbetween weft insertions so as to create the leno fabric LF of FIG. 1.

A leno mechanism, for incorporation into a heald frame loom 78 is designated generally by the reference numeral 80.

The leno mechanism 80 shares common features with the weaving apparatus described hereinabove. These common features share the same reference numerals.

The leno mechanism 80 includes a second drive assembly 82 which includes a plurality of arms 84 each of which is connected to a respective bracket 26. Second connecting rods 86 interconnect the arms 84 with push rods 88 which form part of the frame drive of the heald frame loom 78. This arrangement obviates the need for heald frames thereby allowing the existing frame drive to drive the bar 24 of the leno mechanism 80.

Operation of the leno mechanism 80 is otherwise identical to that of the weaving apparatus 14 described above.

The invention claimed is:

1. An apparatus for weaving leno fabric on a loom including:

a support having pivot means which enable the support to be pivotally mounted on the loom for reciprocal pivotal rotation about a pivot axis, the support carrying a plurality of ground thread blades arranged side by side in a row and spaced apart along the row to define in between neighbouring ground thread blades a guide space for a ground thread running along a predetermined pathway, a leno guide blade being located in each guide space to divide the guide space into first and second guide slots, each leno guide blade having at its terminal end a leno guide eye through which a leno thread is to be guided, adjacent ground thread blades projecting beyond the terminal end of the leno guide blade located therebetween to define a ground thread cross-over space, the ground thread blades and leno guide blades being arranged to extend from said pivotal axis as defined by the pivot means such that pivotal movement of the support in a first rotary direction causes the ground threads to move relatively along one of the first or second guide slots towards and into the cross- over spaces; and such that lateral movement of the ground threads relative to respective leno guide blades, from one side to the other thereof, selectively causes closing of the one of the first or second guide slots and opening of the other of the first or second guide slots, whereby pivotal movement of the support in a second rotary direction opposite to the said first rotary direction causes movement of the ground threads relative to the ground thread blades out of the cross-over spaces and relatively along the other of the first or second guide slots away from the cross-over spaces.

2. An apparatus according to claim 1 further including a ground thread deflection means operable on the ground threads for causing each ground thread to be moved laterally to one side or the other of a respective leno guide blade.

3. An apparatus according to claim 2 wherein the ground thread deflection means comprises a reciprocating bar having a plurality of guide eyes for guiding respective ground threads, the reciprocating bar being movable between first and second positions so as to cause the said lateral movement of the ground threads relative to the leno guide blades.

4. An apparatus according to claim 1, wherein each ground thread blade is sufficiently flexible to enable a ground thread to cause it to be deflected laterally relative to a neighbouring leno guide blade.

5. An apparatus according to claim 1, wherein neighbouring ground thread blades include a retaining means connected between the terminal ends thereof in order to prevent ground threads moving beyond the terminal ends of the ground thread blades and out of said crossover spaces.

6. An apparatus according to claim 5 wherein the retaining means comprises an elongate member which extends across and is connected to the terminal ends of the row of ground thread blades.

7. An apparatus according to claim 1, wherein terminal ends of the leno guide blades and the ground thread blades lie in different radial planes.

8. A leno mechanism for incorporation into a heald frame loom to enable the heald frame loom to weave leno fabric including:

a support having pivot means which enable the support to be pivotally mounted on the heald frame loom for reciprocal pivotal rotation about a pivot axis, the support carrying a plurality of ground thread blades arranged side by side in a row and spaced apart along the row to define in between neighbouring ground thread blades a guide space for a ground thread running along a predetermined pathway, a leno guide blade being located in each guide space to divide the guide space into first and second guide slots, each leno guide blade having at its terminal end a leno guide eye through which a leno thread is to be guided, adjacent ground thread blades projecting beyond the terminal end of the leno guide blade located therebetween to define a ground thread cross-over space;

the ground thread blades and leno guide blades being arranged to extend from said pivotal axis as defined by the pivot means such that pivotal movement of the support in a first rotary direction causes the ground threads to move relatively along one of the first or second guide slots towards and into the cross-over spaces; and such that lateral movement of the ground threads relative to the respective leno guide blades, from one side to the other thereof, selectively causes closing of the one of the first or second guide slots, and opening of the other of the first or second guide slots, whereby pivotal movement of the support in a second rotary direction opposite to the said first rotary direction causes movement of the ground threads relative to the ground thread blades out of the cross-over spaces and relatively along the other of the first or second guide slots away from the cross-over spaces.

9. A leno mechanism according to claim 8 further including a ground thread deflection means operable on the ground threads for causing each ground thread to be moved laterally to one side or the other of a respective leno guide blade.

10. A leno mechanism according to claim 8 wherein the support is driven by a heald frame drive.

11. A leno mechanism according to claim 9 wherein the ground thread deflection means is adapted to be driven by a rotating driveshaft of the heald frame loom.

12. A method of weaving leno fabric on a loom comprising:

(i) arranging a row of side by side ground thread blades to define a plurality of guide spaces, each guide space being for a respective ground thread running along a predetermined pathway;

(ii) arranging a respective leno guide blade within each guide space to define first and second guide slots and a cross-over space therein;

(iii) guiding each leno thread with a respective leno guide blade;

(iv) moving the ground threads relatively along one of the first or second guide slots towards and into the cross-over spaces by pivotally moving the support in a first rotary direction;

(v) moving the ground threads laterally relative to the leno guide blades from one side to the other thereof to selectively cause closing of the one of the first or second guide slots and opening of the other of the first or second guide slots; and (vi) moving the ground threads out of the cross-over spaces and relatively along the other of the first or second guide slots away from the crossover spaces by pivotally moving the support in a second rotary direction opposite to the said first rotary direction.

13. A method according to claim 12 wherein (v) includes guiding each ground thread via a ground thread deflection means.

14. A method according to claim 13 wherein guiding each ground thread via a ground thread deflection means includes guiding each ground thread via a guide eye within a reciprocating bar.

15. A method according to claim 12 wherein (v) further includes deflecting each ground thread laterally relative to a respective leno guide blade so as to cause it to abut and deflect a neighbouring ground thread blade.

16. A method according to claim 12 further comprising (vii) retaining each ground thread within each guide space.

17. A method according to claim 13 wherein (v) further includes deflecting each ground thread laterally relative to a respective leno guide blade so as to cause it to abut and deflect a neighbouring ground thread blade.

18. A method according to claim 12 further comprising (vii) retaining each ground thread within each guide space.

19. An apparatus according to claim 3 wherein neighbouring ground thread blades include a retaining means connected between the terminal ends thereof in order to prevent ground threads moving beyond the terminal ends of the ground thread blades and out of said crossover spaces.

20. An apparatus according to claim 19 wherein the retaining means comprises an elongate member which extends across and is connected to the terminal ends of the row of ground thread blades.

* * * * *